United States Patent [19]

Bennett

[11] Patent Number: 4,705,201

[45] Date of Patent: Nov. 10, 1987

[54] NOSEPIECE FOR APPARATUS FOR INSTALLING FASTENERS

[75] Inventor: Ralph H. Bennett, Poole Dorset, England

[73] Assignee: Avdel Limited, Hertfordshire, England

[21] Appl. No.: 898,831

[22] Filed: Aug. 20, 1986

Related U.S. Application Data

[63] Continuation of Ser. No. 841,686, Mar. 19, 1986, abandoned, which is a continuation of Ser. No. 523,439, Aug. 16, 1983, abandoned.

[30] Foreign Application Priority Data

Aug. 20, 1982 [GB] United Kingdom ..... 8224046

[51] Int. Cl.[4] ..... B21J 15/30; B21J 15/32; B21J 15/34

[52] U.S. Cl. ..... 227/55; 72/391; 227/149

[58] Field of Search ..... 72/391; 227/51, 55, 227/147, 149, 156

[56] References Cited

U.S. PATENT DOCUMENTS

| | | | |
|---|---|---|---|
| 1,726,012 | 8/1929 | Bilz | 227/149 X |
| 2,244,595 | 6/1941 | Amiot | 227/149 X |
| 2,612,281 | 9/1952 | Erhardt, Jr. | 227/149 X |
| 2,901,749 | 9/1959 | Crossen et al. | 227/149 X |
| 3,503,549 | 3/1970 | Brunelle | 227/149 |
| 4,003,417 | 1/1977 | Cornwell | 227/149 X |
| 4,204,439 | 5/1980 | Kondo | 144/32 X |

FOREIGN PATENT DOCUMENTS

| | | |
|---|---|---|
| 1403402 | 10/1968 | Fed. Rep. of Germany . |
| 1503093 | 10/1969 | Fed. Rep. of Germany . |
| 3200367 | 1/1982 | Fed. Rep. of Germany . |
| 1448659 | 6/1966 | France . |
| 632069 | 11/1949 | United Kingdom . |

*Primary Examiner*—Paul A. Bell

*Attorney, Agent, or Firm*—Oblon, Fisher, Spivak, McClelland & Maier

[57] ABSTRACT

A nosepiece for temporarily supporting a fastener in front of a fastener installation tool is disclosed. The nosepiece comprises a split support provided by a plurality of support members which define between them a cavity which receives the fastener. The fastener is supported peripherally by the support members which can move to allow a fastener to move through said members in a forwards direction, from the back to the front of the nosepiece to allow installation of the fastener. The support members also restrain undesired movement of the fastener in the cavity in the reverse direction (i.e. from the front to the back of the nosepiece) as well as undesired movement in the forwards direction.

11 Claims, 10 Drawing Figures

NOSEPIECE FOR APPARATUS FOR INSTALLING FASTENERS

This application is a continuation of application Ser. No. 841,686, filed 3/19/86 now abandoned which is in turn a continuation of Ser. No. 523,439, filed 8/16/83 now abandoned.

The invention relates to a nosepiece for apparatus for installing fasteners.

Apparatus for installing fasteners such as screws, bolts, nuts, threaded inserts, blind rivets and the like is well known, and in general comprises a power-operated tool which installs the fasteners by the appropriate action of rotating the fasteners (in the case of screws, bolts and nuts) or pulling the fasteners (in the case of threaded inserts and blind rivets).

In general, either each successive fastener is supplied manually, one at a time, to the outside of the tool, or successive fasteners are supplied automatically within the tool.

The present invention relates to a nosepiece for temporarily supporting a fastener in front of an installation tool so that the fastener can be picked up by the tool and installed.

The invention provides a nosepiece for apparatus for installing fasteners, which nosepiece comprises a split support provided by a plurality of support members which define between them a cavity which receives the fastener and supports it peripherally, which support members can move to allow the movement of a fastener therethrough in a forwards direction from the back to the front thereof to be installed, and fastener restraining means for restraining undesired movement of the fastener in the cavity in the reverse direction from the front to the back thereof, the fastener restraining means being movable, independently of movement of the support members, to allow a fastener to enter the cavity in a forwards direction, and then to restrain it against undesired movement in the reverse direction as aforesaid. Preferably the fastener restraining means also restrains the fastener against movement in a forwards direction, and is movable in unison with the support members to allow movement of the fastener in a forward direction as aforesaid. When the nosepiece includes first biassing means for biassing the support members towards their support position, preferably it also includes second biassing means for biassing the restraining means towards its restraining position. When the support members are biassed towards their support position, preferably the fastener restraining means is biassed towards its restraining position with a biassing force different in magnitude from that biassing the support members.

Preferably the fastener restraining means is interposed between adjacent ones of the plurality of support members. Preferably common guiding means is provided both for guiding the movement of the support members and for guiding the movement of the fastener restraining means. Preferably the common guiding means comprising common pivoting means. Preferably at least one support member and an adjacent fastener restraining means are both provided by adjacent parts of respective lever members mounted on a common pivoting means, and there is provided spring means acting on both lever members so as to urge the support member towards its support position and the fastener restraining member towards its restraining position, the spring means acting on the lever carrying the fastener restraining means at a position closer to the common pivoting means than the spring means acting on the lever carrying the support member. Preferably a pair of support members with a fastener restraining member between them are mounted on a common pivoting means, and one spring means acts on both levers providing the two support means.

Preferably the nosepiece includes two pairs of support members, one pair being opposed to the other pair, and a fastener restraining means positioned between the two support members of each pair.

Preferably the two fastener restraining means are positioned opposite each other.

The invention includes apparatus for installing fasteners, incorporating a nosepiece as aforesaid.

A specific embodiment of the invention will now be described by way of example and with reference to the accompanying drawings, in which.

Figure 4:
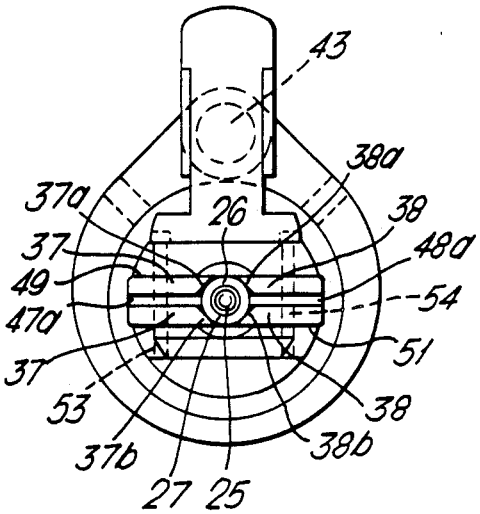
FIG. 4 is a front end elevation of the nosepiece of FIG. 3.
Figure 6:
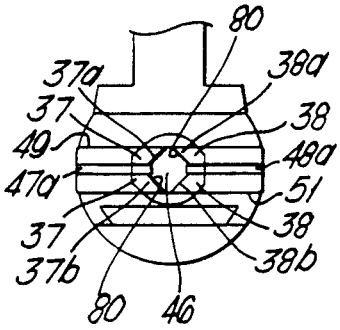
Figure 3:
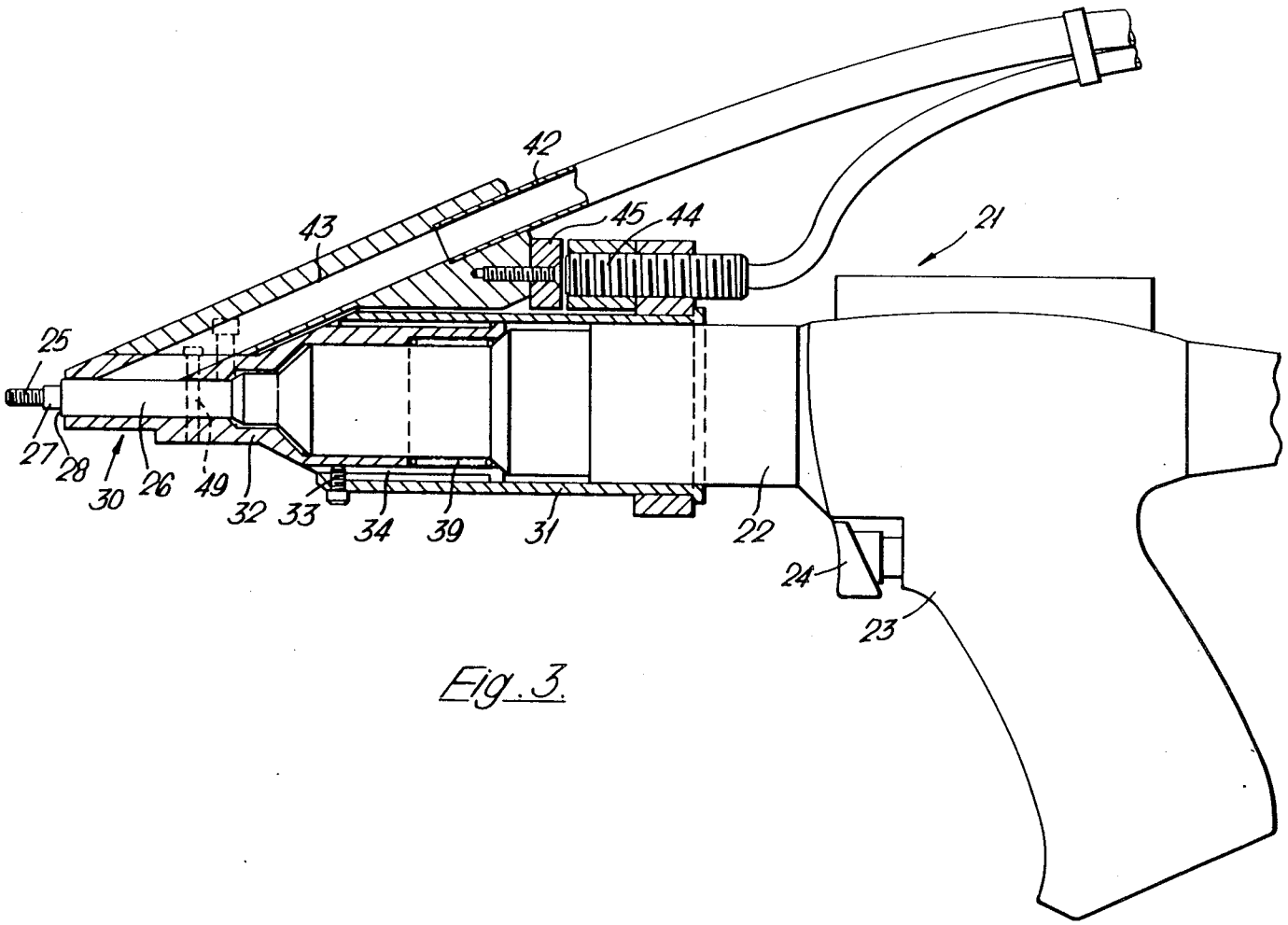
FIG. 3 is a partial axial section and partial side elevation of a hand held power installation tool incorporating a nosepiece.
Figure 5:
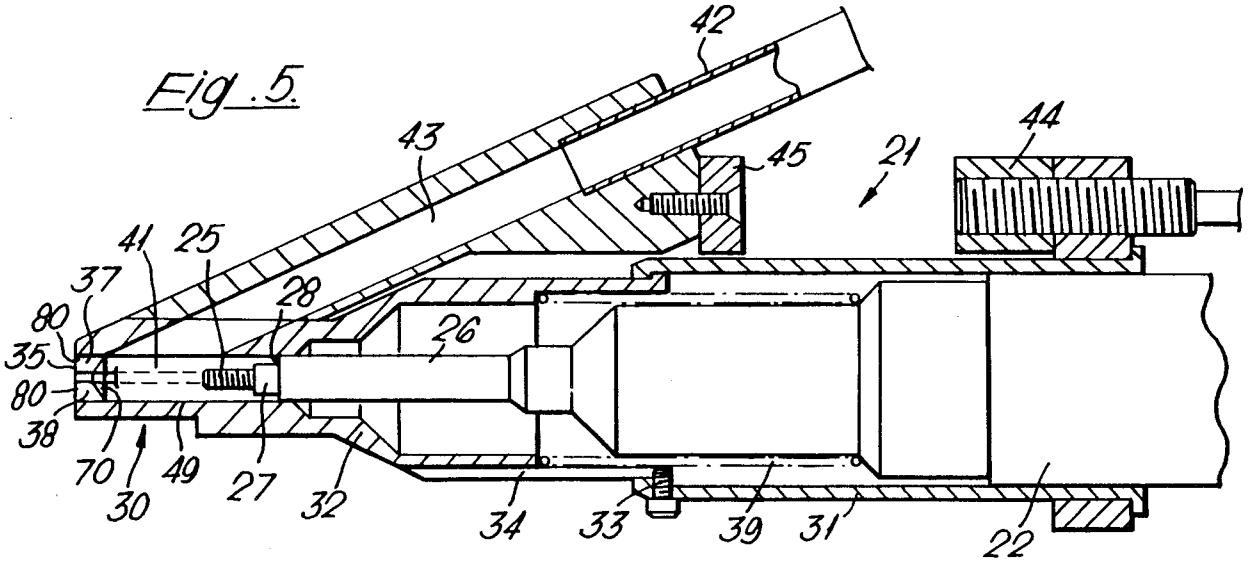
Figure 8:
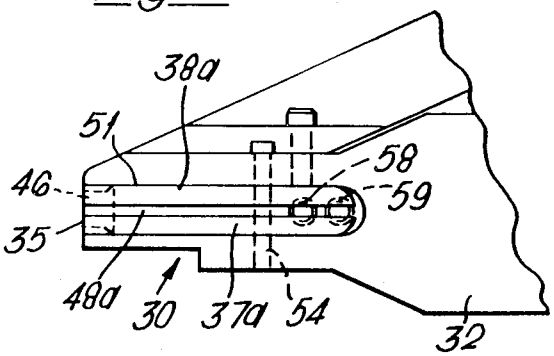
Figure 7:
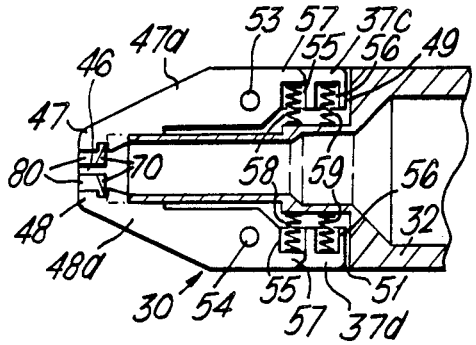
Figure 9:
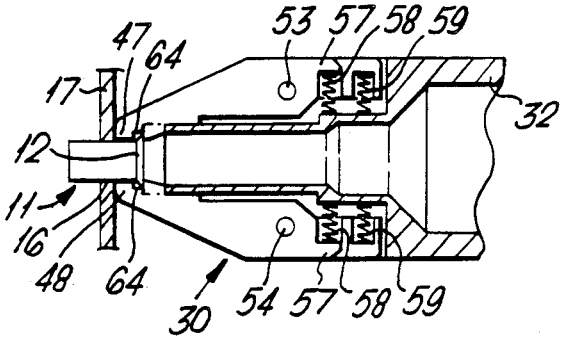
Figure 10:
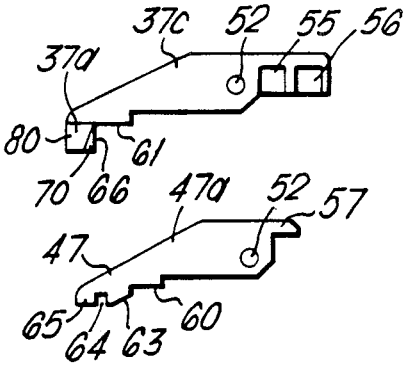

FIG. 5 corresponds to part of FIG. 3 but shows the mandrel in the retracted position;

FIG. 6 corresponds to FIG. 4 but shows the mandrel in the retracted position;

FIG. 7 is a horizontal axial section through the nosepiece with the mandrel in the retracted position;

FIG. 8 is an exterior side elevation of the nosepiece;

FIG. 9 is similar to FIG. 7 but shows an insert retained in the nosepiece and in position in a hole in a sheet;

FIG. 10 is a side elevation of an abutment lever member and an insert restraining lever member.

Figure 1:
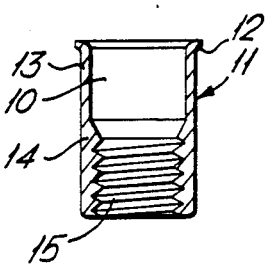
FIG. 1 is an axial section through an insert to be installed.

The insert 11 illustrated in FIG. 1 is made of zinc plated steel and is generally tubular in form with a bore 10 extending completely through it. Its exterior surface is cylindrical except for a radially enlarged countersink head 12 at one end. The part 13 of the insert adjacent the head is relatively thin walled, but the part 14 more remote from the head has a thicker wall and is internally threaded at 15. In use the insert is inserted into a suitable hole 16 (see FIG. 2) in a sheet 17 and is axially collapsed by pulling the threaded portion 15 whilst supporting the head 12, with the result that the part 13 buckles outwards to form an annular fold 13*a* and the head is deformed outwards as shown as 12*a*, so that the insert securely grips the sheet. Such inserts are well known in the mechanical assembly industry.

The installation tool 21 of this example illustrated in FIGS. 3–10 comprises a reversible air motor tool including a body 22, pistol grip 23, and actuating trigger 24. The air motor drives, through a torque-limiting mechanism, a rotatable threaded mandrel 25 which protrudes from the front part 26 of the tool body. A sliding spring sleeve 27 surrounds the protruding mandrel. The male thread on the mandrel 25 corresponds to the female thread 15 on the insert to be installed, and the outside diameter of the spring sleeve 27 is a clearance fit within the thin walled part 13 of the insert. The annular end face 28 of the front part 26 of the tool is serrated in order to engage the head 12 of the insert and to support it and resist rotation of the insert during installation. Such an installation tool is well known in connection with inserts of the type described.

The installation tool of this example is provided with an attachment for feeding inserts automatically to the mandrel. This attachment comprises an adaptor sleeve 31 secured to the tool body 22 and carrying, for axial reciprocation in relation to the tool, a nose assembly 32. This is prevented from rotating about the body by means of a set screw 33 projecting through the sleeve 31 and projecting into a longitudinal groove 34 on the underside of the exterior of the nose assembly. At its forward end the nose assembly 32 includes a nosepiece 30. This includes a split support provided by two pairs 37, 38 of support members, the pair 37 being on the left and the pair 38 being on the right as shown in the FIGS. 4 and 6.

A coil compression spring 39 urges the nose assembly 32 into a forwards position as illustrated in FIG. 5. In this position there is a space 41 behind the support members 37, 38 and in front of the mandrel 25, into which an insert can be fed by means of compressed air flow along a supply hose 42 connected to a supply bore 43 in the top of the nosepiece assembly 32 at an acute angle to the mandrel axis. The forward end of the supply bore 43 opens into the space 41, and inserts are fed along the supply hose 42 one at a time, when required, by means of a bowl hopper and escapement device of known type. The escapement is actuated by a proximity switch 44 mounted on top of the adaptor sleeve 31 which is operated by a magnet 45 secured to the top of the nosepiece assembly 32. The insert feeding system is arranged to ensure that a new insert is fed, threaded end first, into the space 41 when the mandrel is in its fully retracted position as shown in FIG. 5.

When each new insert is thus delivered, its velocity and the flow of compressed air propelling it are sufficient to drive it into the cavity 46 which is defined between the pairs of support members 37,38. The nosepiece 30, including these support members and their associated insert restraining means, will now be described.

Each support member 37*a*, 37*b* of the pair 37, and each support member 38*a*, 38*b* of the pair 38, is provided as part of a lever member 37*c*, 37*d* and 38*c*, 38*d* respectively. FIG. 10 illustrates the lever member 37*c* carrying the support member 37*a* at its front end. Each pair of lever members has, sandwiched between them, a third lever member 47*a*, 48*a* respectively, formed at its front end with an insert restraining member 47,48 respectively. Each set of three lever members is shaped to fit into a longitudinal slot 49 or 51 in the nosepiece 34, the two slots being opposite each other. All three lever members are provided with a pivot hole 52 towards its rear end, the pivot holes of the set of levers 37*c*, 47*b* and 37*d* being journaled on a pivot pin 53 running through the slot 49, and the pivot holes of the other set of levers 38*c*, 48*a* and 38*d* being journaled on a pivot pin 54 running through the other slot 51. Referring to the particular lever members 37*c* and 47*a* shown in FIG. 10, behind its pivot hole 52 the support lever 37*c* is formed with two part-cylindrical recesses 55 and 56 one behind the other, whereas the insert restraining lever 47*a* is formed with a short lug 57 which lies outside the outer end of the recess 55 nearer the pivot. The other support lever 37*d* is a mirror-image of the lever 37*c*, so that when the three levers 37*c*, 47*a* and 37*d* are assembled on the pivot pin 53 in the slot 49, the two opposing recesses 55 form together a substantially cylindrical chamber, and likewise the two opposing recesses 56 form together a substantially cylindrical chamber. As will be apparent from FIGS. 7 and 9, the chamber formed by recesses 55 houses a small compression spring 58 which acts on the lug 57 to urge the insert restraining member 47, at the other end of the lever, radially inwardly of the nosepiece 30. The radially inward position of the member 47 is determined by contact of part 60 of the lever with part of the inside of the slot 49. Similarly, the chamber formed by the recesses 56 houses a second small compression spring 59 which acts on the end walls of the two recesses 56 to urge the two support members 37*a*, 37*b*, at the other ends of the levers 37*c*, 37*d*, inwardly of the nosepiece. The inward position of the support member is determined by contact of part 61 of the lever with part of the inside of slot 49.

The support members are shaped as is shown in FIG. 10 and FIG. 6, with a face 80 at an angle of 45 degrees. When all the support members 37*a*, 37*b*, 38*a*, 38*b* are closed towards each other as just described, they define between their faces 80 the previously mentioned cavity 46 into which the outside of the body of an insert 11 will just enter. The rearwards end of each support member face 80 is dished or chamfered as illustrated at 70, in order to facilitate entry of the insert into the cavity 46 defined by the faces 80. The head 12 of an insert will just enter between the chamfered faces 70 but will not pass any further.

The front faces of the support members provide an annular front face 35 on the nosepiece.

Each insert restraining member is shaped as is illustrated in FIG. 10 with reference to the member 47. At its rearmost end it has a sloping face 63, than a small notch 64, and then towards its forwards end a straight edge portion 65. The relationship of the shapes of the support members and insert restraining members is such that, when they are aligned on their respective pivot pins in their respective slots 49,51, and held inwardly under the urging of the springs 58,59 as previously described, the notches 64 are aligned just forwardly of the rearwards faces 66 of the support members, level with the faces 70.

It is arranged that the force urging the insert restraining members 47,48 together (into their insert restraining position) is substantially less than the force urging the support members 37*a*, 37*b*, 38*a*, 38*b* together (into their closed position). This is facilitated by the fact that the springs 58 acting on the insert restraining levers 47*a*, 48*a* do so at a position much closer to the common pivot pin 53 or 54 than the springs 59 acting on the support levers. (The ratio of distances in this example is about 1:2).

The action of the support levers and insert restraining levers, in guiding, restraining and releasing the insert, will now be described.

As previously described, the velocity and propelling airflow of a new insert delivered along the supply bore 43 into the space 41 is sufficient to make it enter the support cavity 46. In doing so, it forces apart the insert restraining members 47,48, the leading end of the insert striking and camming apart the opposed inclined faces 63. The insert continues its entry into the cavity being assisted by the chamfer 70, until the radially enlarged head 12 of the insert, which is now at its rear or trailing end, also contacts the opposed inclined faces 63 and forces them apart so that it can pass through. When the head 12 of the insert passes the forward ends of the inclined faces 63 and is level with the notches 64, the head hits the chamfered faces 70 of the support members, and immediately stops. The insert restraining members close together, since the notches 64 accommodate the radially projecting insert head 12. As illustrated in FIG. 9, about half of the length of the insert projects forwardly of the nosepiece front face 35. The insert is supported peripherally by the faces 80 of the support members defining the cavity 46 which contact it along about half its length. It is restrained against axial movement forwardly of the nosepiece by the engagement of its head 12 with the chamfered faces 70 of the support members and with the notches 64, and against axial movement rearwardly by engagement with the notches 64 of the insert restraining members 47, 48. The operator now manipulates and moves the tool so as to make the protruding part of the insert enter the hole 16 in the sheet 17. This is facilitated by the support given to the insert by the members, and in particular by the restraint to rearwards movement of the insert provided by the notches 64 of the insert restraining members. The insert is so positioned that it enters the hole 16 until the face 35 of the nosepiece abuts the nearer face of the sheet 17, and the threaded part of the insert protrudes beyond the remote face of the sheet. This is the position illustrated in FIG. 9 (the mandrel 25 and front 26 of the tool are omitted for clarity of illustration).

The operator now pushes the tool body towards the sheet, (keeping the tool axis perpendicular to the sheet in order to keep the insert also in this allignment), compressing the spring 39. At the same time the operator presses the tool trigger 24 to start the tool motor rotating the mandrel 25 clockwise. As the spring 39 compresses, the mandrel 25 advances towards the insert and eventually enters the bore 10 at the head end. When the mandrel reaches the threaded part 15 it starts screwing into it, whilst the forward end of the sprung sleeve 27 enters the bore 10.

Figure 2:
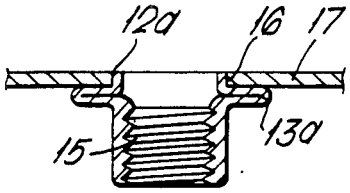
FIG. 2 is an axial section through the insert installed in a sheet.

At about this stage (depending on the precise dimensions of the insert and their relationship to the relative axial position of the mandrel 25 and the front part 26 of the tool), the front end face 28 of the tool reaches the inclined faces 63 of the insert restraining members 47 and forces them open, withdrawing the notches 64 from engagement with the head 12 of the insert. It then also engages the chamfered faces 70 at the rear of the support members and forces the members apart, thus removing the chamfered faces 70 of the support members from engagement with the insert head 12. The insert is thus released to move forward under the thrust of the forwards end 28 of the tool until the head passes beyond the front end face 35 of the nosepiece. The installation tool now proceeds to instal the insert in the usual way. The head 12 of the insert is pressed firmly against the near face 17 by the forward end face 28 of the tool, and the continued rotation of the mandrel 25 in the thread 15 of the insert exerts an axial compression on the insert, causing its wall portion 13 to buckle and fold into contact with the rear face of the sheet, whilst the head 12 may also be deformed towards the front face of the sheet to install the fastener in the sheet. When the insert is fully collapsed the torque-limiting device in the tool operates, and the operator reverses the direction of the rotation of the air motor to unscrew the mandrel from the insert, leaving the installed fastener in the sheet as illustrated in FIG. 2, to provide an anchor nut in the sheet. As the operator withdraws the tool from the sheet, the spring 39 returns the nose assembly 32 to its forwards position shown in FIG. 5.

The invention is not restricted to the details of the foregoing example. For instance, the nosepiece could be adapted for use with an installation tool for installing other types of fasteners, e.g. screws, bolts, nuts, or rivets.

The example nosepiece described above is advantageous in that it enables an existing fastener installation tool to be fed with fasteners from the outside of the tool. The construction and arrangement of the restraining means interposed between adjacent support members results in a compact nosepiece which facilitates the installation of fasteners in places with limited access.

The arrangement of the four faces 80 of the support members allows the nosepiece to be used for the installation of inserts both of cylindrical external cross-section and of hexagonal external cross-section. Although in the latter case the faces of the hexagon would make angles of 60° with the axial plane across the nosepiece in which the insert restraining members 47, 48 lie, it is found in practice that by arranging the faces 80 of the support members at angles of 45° to that plane, the support members will operate satisfactorily on inserts of both cylindrical external cross-section and hexagonal external cross-section.

Although the invention has been described in the foregoing example by reference to a separate nosepiece assembly attached to a fastener installation tool, the nosepiece could equally well be provided as an integral part of a complete fastener installation apparatus.

I claim:

1. A nosepiece for an apparatus for installing fasteners having a radial enlargement, which nosepiece comprises:

a split support provided by a plurality of support members positionable in a support position to define between them a cavity which receives the fastener and supports the fastner peripherally, which support members can move from said support position to allow the movement of a fastener therethrough in a forwards direction from the back to the front thereof to be installed;

and fastener restraining means having means cooperating with the radial enlargement of a fastener for restraining undesired movement of a fastener in the cavity both in the forwards direction and in the reverse direction from the front to the back thereof when said fastener restraining means is in a restraining position and a fastener is in said cavity for support by said support members;

the fastener restraining means including means responsive to movement of a fastener in the forwards direction into said cavity for moving said fastener restraining means from said restraining position, while said support members remain in said support position, to allow a fastener to enter said cavity in the forwards direction, and means to return said fastener restraining means to said restraining position to restrain said fastener against undesired movement in both the forwards and the reverse direction;

the fastener restraining means also being movable from said restraining position in unison with movement of the support members from said support position to allow movement of the fastener in the forwards direction.

2. A nosepiece as claimed in claim 1 including first biasing means for biasing the support members towards said support position, and second biasing means for biasing the restraining means towards said restraining position.

3. A nosepiece as claimed in claim 2, in which the support members are biased towards said support position by said first biasing means, and the fastener restraining means is biased towards said restraining position by said second biasing means with a biasing force different in magnitude from that biasing the support members.

4. A nosepiece as claimed in claim 1 or 2 or 3, including two pairs of support members, one pair being opposed to the other pair, and a fastener restraining means positioned between the two support members of each pair.

5. A nosepiece as claimed in claim 4, in which the two fastener restraining means are positioned opposite each other.

6. A nosepiece as claimed in preceding claims 2 or 3, in which the fastener restraining means is interposed between adjacent ones of the plurality of support members.

7. A nosepiece as claimed in claim 6, in which common guiding means is provided both for guiding the movement of the support members and for guiding the movement of the fastener restraining means.

8. A nosepiece as claimed in claim 7, in which the common guiding means comprising common pivoting means.

9. A nosepiece as claimed in claim 8, in which at least one support member and an adjacent fastener restraining means are both provided by adjacent parts of respective lever members mounted on a common pivoting means, said first and second biasing means comprising first spring means acting on one of said lever members so as to urge the support member towards said support position and second spring means acting on another of said lever members so as to urge said fastener restraining means towards said restraining position, the second spring means acting on the lever carrying the fastener restraining means acting at a position closer to the common pivoting means than the first spring means acting on the lever carrying the support member.

10. A nosepiece as claimed in claim 9, in which a pair of support members with a fastener restraining member between them are mounted on a common pivoting means, and one first spring means acts on both levers providing the two support members.

11. The nosepiece claimed in claim 1 wherein said means for restraining undesired movement of the fastener comprise a notch in said fastener restraining means, said notch being positioned so as to restrain a portion of a fastener when said fastener restraining means is in said restraining position.

* * * * *